US005481991A

United States Patent [19]

Geerts

[11] Patent Number: 5,481,991

[45] Date of Patent: Jan. 9, 1996

[54] DEVICE FOR INSERTING ELONGATED ARTIFICIAL GRASS FIBRES INTO THE GROUND

[75] Inventor: Jan F. M. Geerts, Leest-Mechelen, Belgium

[73] Assignee: Tapijtfabriek H. Desseaux N.V., Netherlands

[21] Appl. No.: 204,307

[22] PCT Filed: Oct. 9, 1992

[86] PCT No.: PCT/NL92/00182

§ 371 Date: Jun. 30, 1994

§ 102(e) Date: Jun. 30, 1994

[87] PCT Pub. No.: WO93/08332

PCT Pub. Date: Apr. 29, 1993

[30] Foreign Application Priority Data

Oct. 14, 1991 [NL] Netherlands ..... 240227

[51] Int. Cl.[6] ..... A01C 7/00

[52] U.S. Cl. ..... 111/200; 111/901

[58] Field of Search ..... 111/199, 200, 111/901, 902, 115; 47/9 M; 273/176 H, 195 A, 176 FA, 176 J; 405/24, 258; 112/2

[56] References Cited

U.S. PATENT DOCUMENTS

| | | | |
|---|---|---|---|
| 3,154,031 | 10/1964 | Kappelmann | 47/9 |
| 3,801,421 | 4/1974 | Allen et al. | 161/67 |
| 4,012,545 | 3/1977 | Toland | 428/95 |
| 4,236,581 | 12/1980 | Beckett | 111/200 X |
| 4,287,243 | 9/1981 | Nielsen | 428/17 |
| 4,294,179 | 10/1981 | Cayton et al. | 111/115 |
| 4,694,606 | 9/1987 | Wood et al. | 111/199 X |

*Primary Examiner*—Randolph A. Reese
*Assistant Examiner*—Victor Batson
*Attorney, Agent, or Firm*—Cushman, Darby & Cushman

[57] ABSTRACT

The invention relates to a device (51) for inserting elongated artificial grass fibres (30) into the ground. The device (51) is provided with a frame (40), which is movable across the ground and which has at least one planting pin (25) being movable up and down in the frame (40), as well as with means for placing an artificial grass fibre (30) to be inserted into the ground under said planting pin (25), in such a manner that the fibre in question can at least partially be pressed into the ground by the planting pin (25) subsequently moving downwards. Preferably the device is provided with a plurality of planting pins (25), which are arranged in a row extending transversely to the intended direction of movement of the device, and which can jointly be moved up and down with respect to the frame by setting means.

12 Claims, 7 Drawing Sheets

DEVICE FOR INSERTING ELONGATED ARTIFICIAL GRASS FIBRES INTO THE GROUND

A device for inserting elongated artificial grass fibres into the ground.

The invention relates to a device for inserting elongated artificial grass fibres into the ground.

As explained in the prior Dutch Patent Application No. 9100202 it may be desirable to insert artificial grass fibres into the ground in order to improve a field comprising natural grass, which is e.g. used for practicing sports or the like.

With such a construction the artificial grass fibres must be inserted into the ground individually. In view of the large dimensions of a playing field and the desired rather small spacing between the fibres, inserting the fibres by hand will take up too much time and be too costly.

The object of the invention is therefore to provide a possibility to effect said inserting into the ground of individual artificial grass fibres by machine.

According to the invention this can be achieved in an efficient manner by means of a device which is provided with a frame, which is movable across the ground and which has at least one planting pin being movable up and down in the frame, as well as with means for placing an artificial grass fibre to be inserted into the ground under said planting pin, in such a manner that the fibre in question can at least partially be pressed into the ground by the planting pin subsequently moving downwards.

The invention will be explained in more detail in the following description, wherein reference is made to the accompanying drawing, in which:

FIG. 1 diagrammatically illustrates the operation of an embodiment of a device according to the invention for planting artificial grass fibres into the ground;

As described in the prior Dutch Patent Application No. 9100202 it is possible, e.g. in order to improve a grass field, to insert artificial grass fibres consisting of a plastic material into the ground in a position in which said fibres are folded in two.

It is to be preferred thereby to insert the fibres into the culture medium in regularly spaced relationship. This regular spacing can be obtained by providing the fibres in a certain pattern, such as on the corner points of an imaginary equilateral triangle. The dimension of the sides of said equilateral triangle can be varied, preferably from 1–3 cm.

Figure 1:
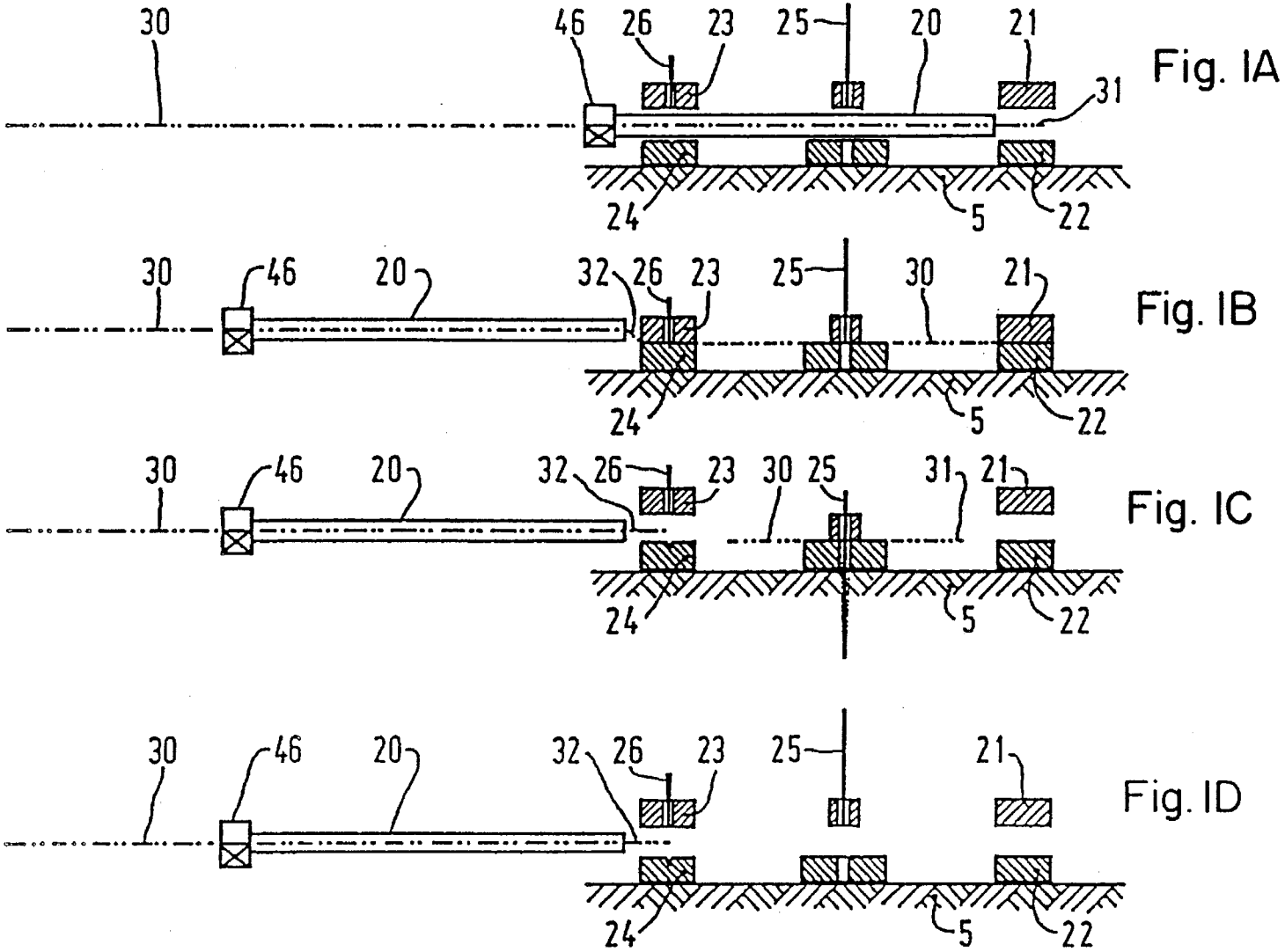

In order to insert the fibres 1 into the culture medium 5 in an efficient manner a fibre planting machine such as illustrated in FIG. 1 has been developed. Before discussing the device shown in FIG. 2, reference is first made to FIG. 1, which diagrammatically indicates the operation of the fibre planting machine according to the invention. In FIG. 1 step A illustrates the first situation of the device shown in FIG. 2, for providing the end 31 of the fibre 30 between the clamping blocks 21–22. In situation B the tube 20 is retracted from the clamping blocks, leaving behind the fibre 30, whereby the clamping blocks 21 and 23 are respectively provided on the lower clamping blocks 22 and 24, so that at its ends the fibre 30 is fixed between the clamping blocks. The projecting end of the fibre, indicated at 31 in situation A, is clamped down between the clamping blocks 21 and 22. Furthermore the knife 26 is moved downwards in the clamping blocks 23 and 24 in situation B, so that the fibre 30 is cut through and the end 32 can become disengaged after the clamping blocks 23 and 24 have been separated. In addition the planting pin 25 is moved downwards, so that said pin rests on the fibre 30.

According to situation C the fibre 30 is moved downwards under the influence of the planting pin 25, since the clamping blocks 21 and 23 are moved upwards as soon as the planting pin 25 comes into contact with the fibre 30, so that the fibre 30 will become disengaged from the clamping blocks near its ends 31 and 32 and be pressed into the ground, in particular into the culture medium 5, under the influence of the planting pin. In situation D the device is ready for the next cycle again. As soon as the planting pin 25 has been returned to the highest position, the tube 20 can be moved forwards, so that the fibre end 32 is placed between the clamping blocks 21 and 22 and said end becomes the end 31, as is indicated in situation A.

Subsequent to this explanation of the principle of operation of the fibre planting machine, the machine itself will now be explained in more detail in the following description, wherein reference is made to FIG. 2, wherein the parts of the device of FIG. 2 have been given the same numerals as in FIG. 1, insofar as they relate to the same parts.

Figure 2:
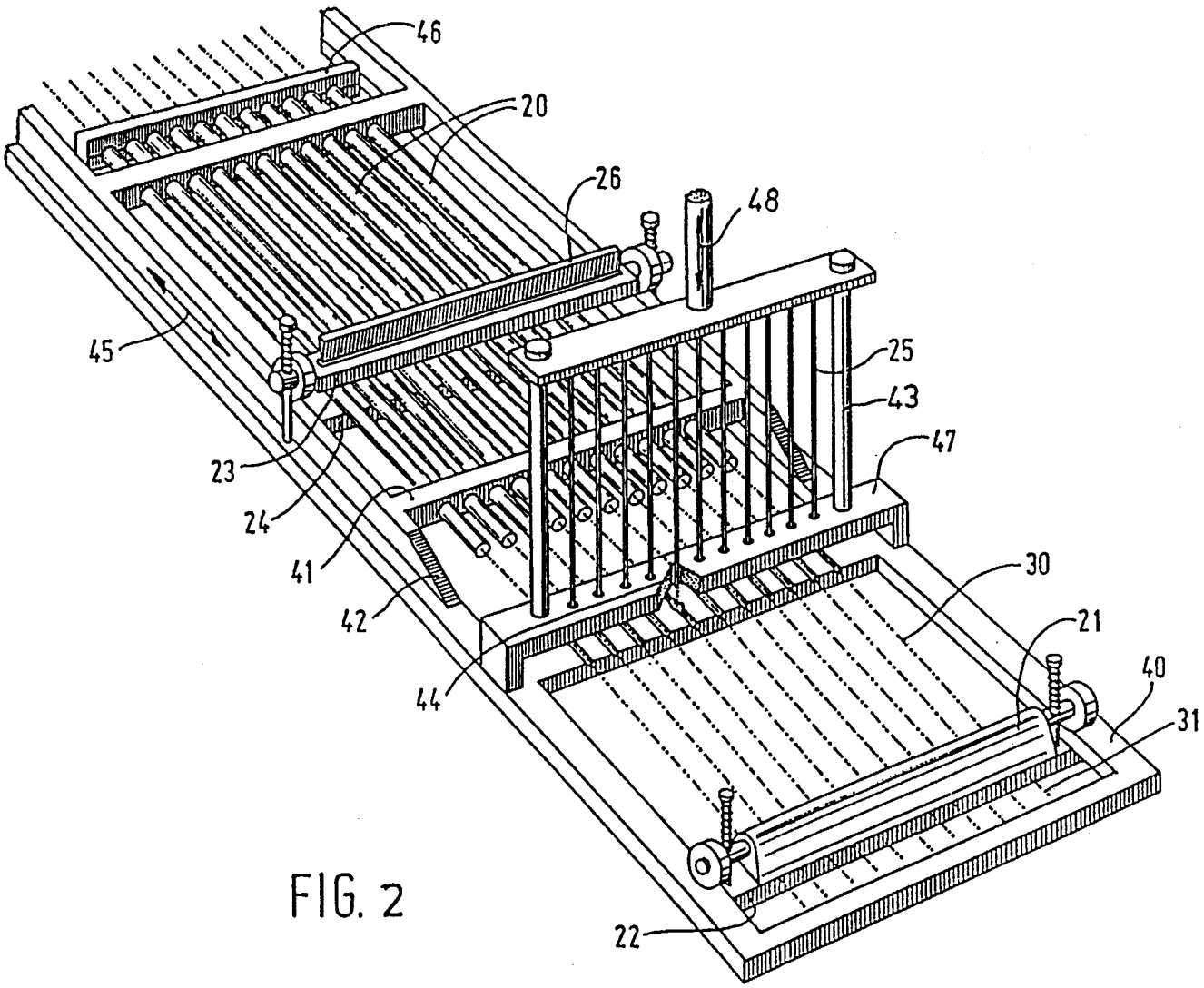
FIG. 2 is a diagrammatic, perspective view of an embodiment of a device according to the invention for planting artificial grass fibres into the ground.

FIG. 2 illustrates the fibre planting machine, whereby the tubes 20 are located in a situation between A and B of FIG. 1, since the tubes 20 are in a retracting motion, as the fibres 30 are clamped down between the clamping blocks 21 and 22. The fibres 30 inside the tubes 20, partially being free from the clamping blocks 21–22, are disposed within a frame 40, on which a frame 41 is provided, which can move as a whole in the directions indicated by the double arrow 45. The front end of the frame 41 has a sloping end 42, which, as soon as it comes into contact with the clamping blocks 22 and 21, will move the clamping blocks 21 upwards, so that the tubes 20 can arrange for the end 31 of the fibre 30 to land between the clamping blocks 21 and 22. The ends of the tubes 20 are assembled in the tube holder 46. The guide 43 for the aggregate of planting pins 25 extends perpendicularly to the frame 40. Said guide 43 can be made to move up and down, as indicated by the double arrow 48. The guide 44 for the planting pins is illustrated in open view in the supporting beam 47. It will be apparent that the pin guides must be positioned accurately with respect to the fibre 30, because the fibres 30 must be taken along when the planting pins 25 move downwards. The knife 26 is illustrated in the clamping block 23. The drawing furthermore shows a few adjusting means near the clamping blocks 21 and 23, although said means will not be discussed in more detail herein. Furthermore it will be apparent that, although the planting pins 25 are arranged in the beam 47 in a row, it is also possible to provide the planting pins 25 in the beam 47 in staggered relationship, so that a certain desired pattern of the fibres 30 inserted in the culture medium 5 can be obtained. It is also possible to provide several rows of planting pin guides 43 on the frame 40. The various movable parts on the frame 40 can be driven, attuned to each other, by means of a hydraulic motor.

Figure 3:
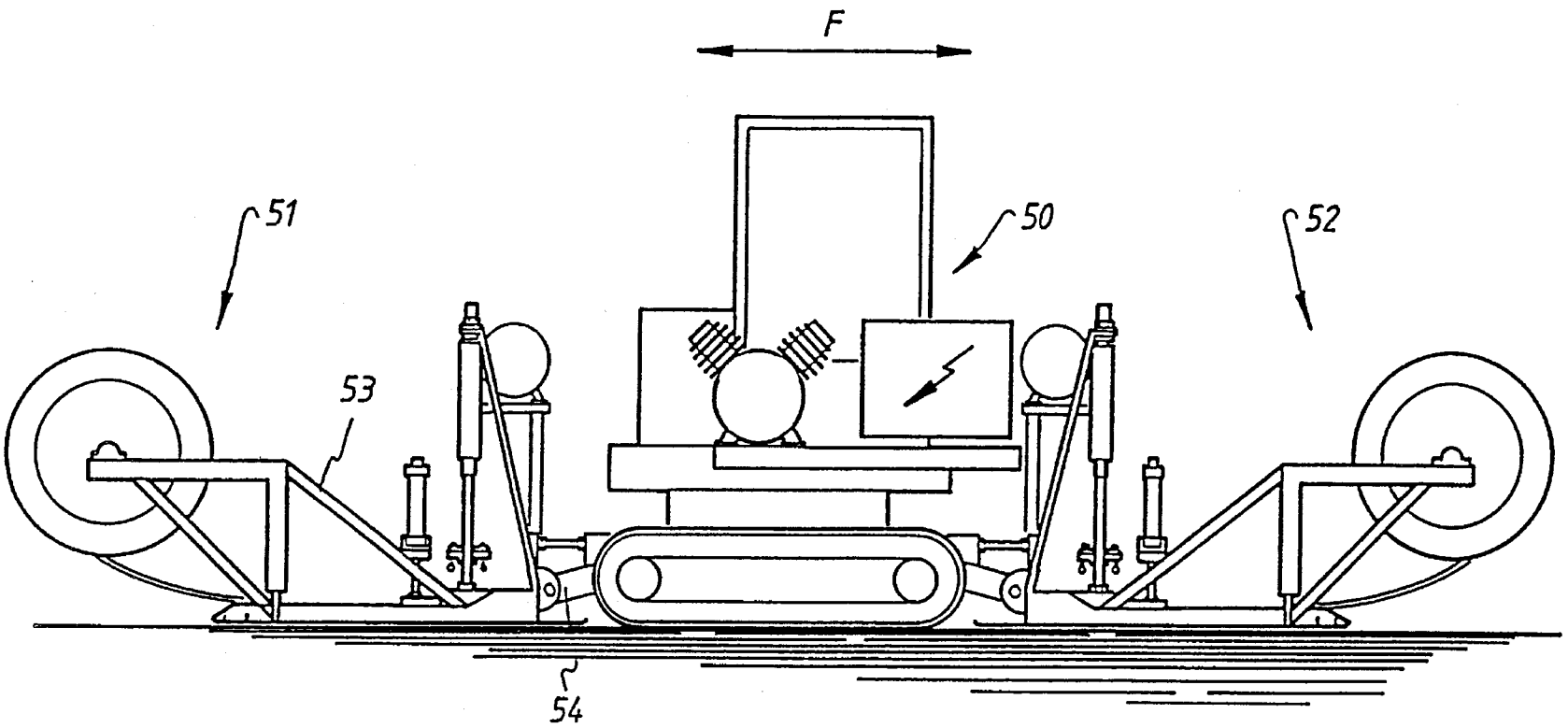
FIG. 3 is a diagrammatic side view of two devices according to the invention, which are coupled to the front and the rear of a tractor respectively.

FIG. 3 shows a combination of a tractor 50 with two devices 51 and 52 being arranged on either side of said tractor 50 and being coupled to said tractor, which devices are suitable for inserting elongated artificial grass fibres into the ground.

For that purpose the devices 51 and 52 can be driven to and fro by the tractor 50, as indicated by means of the double arrow F.

Since the devices 51 and 52, which are turned through 180° relative to each other, have at least substantially the same construction, only the device 51 will be described hereafter.

As is diagrammatically illustrated in FIG. 3, the device 51 comprises a frame 53, which is vertically adjustably connected to the frame of the tractor 50 by usual coupling means 54.

Figure 4:
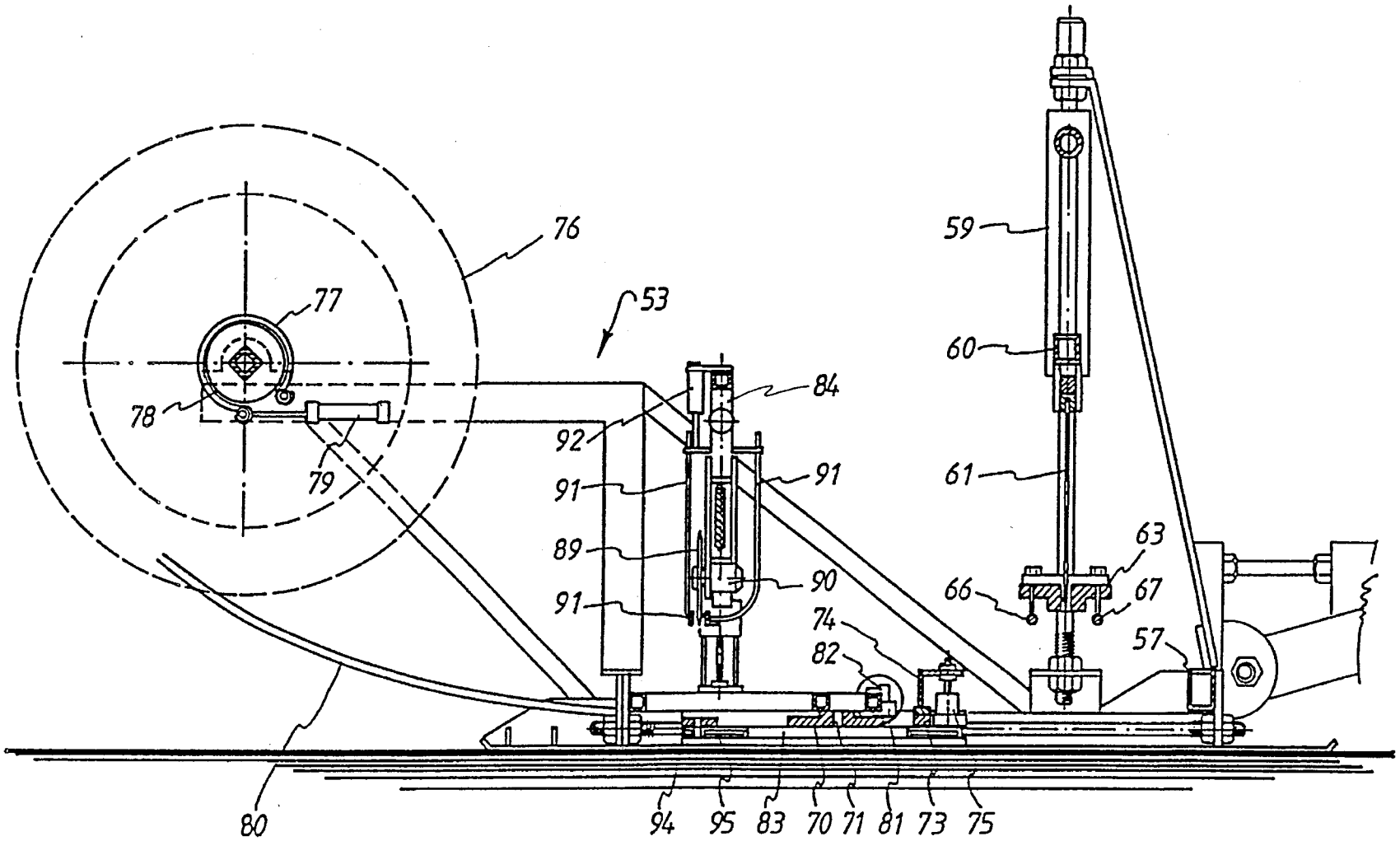
FIG. 4 is a larger-scale side view of a part of one of the devices shown in FIG. 3, in a first operating position.
Figure 5:
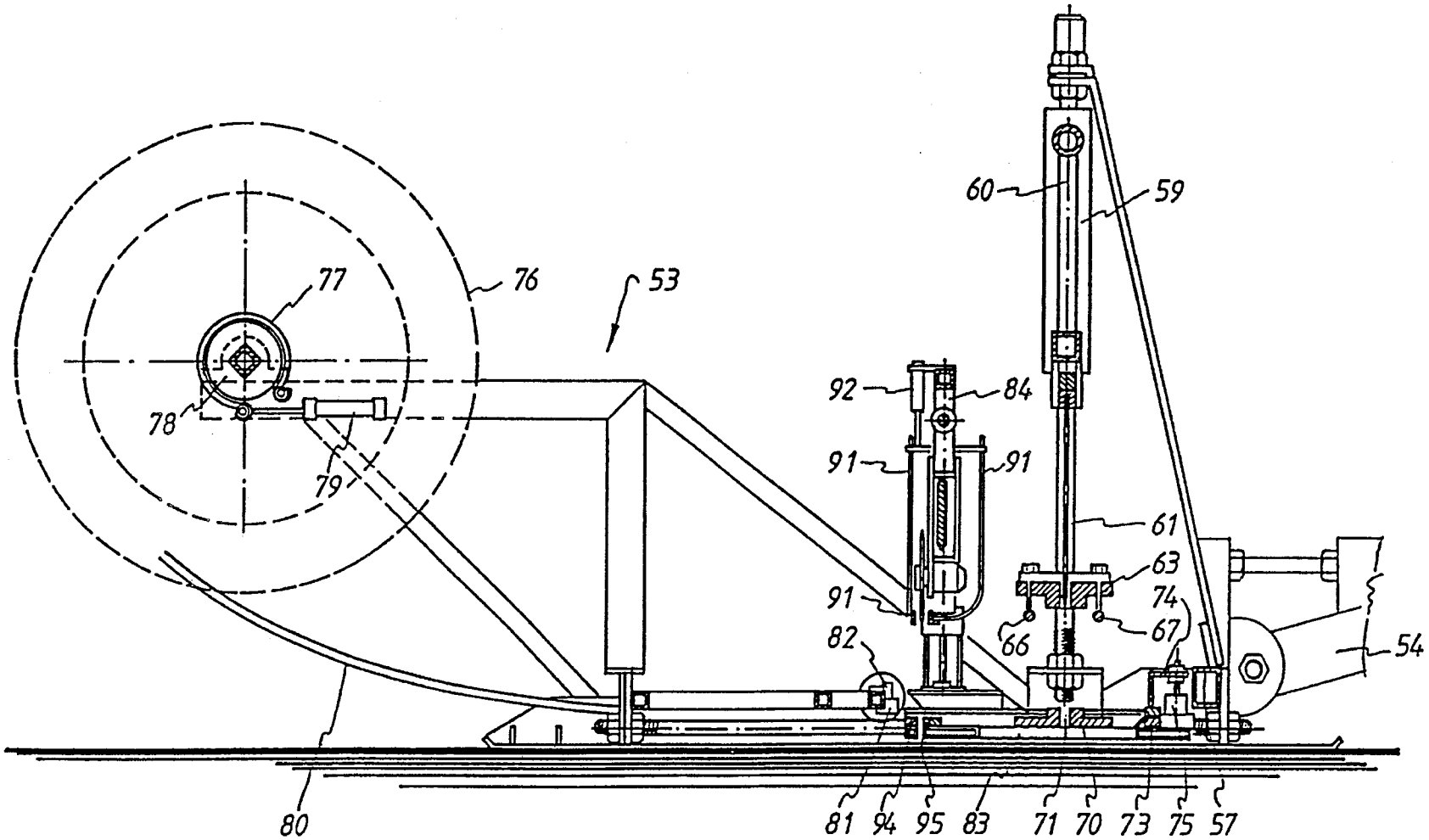
FIG. 5 is a view corresponding with FIG. 6, in a second operating position of the device.
Figure 6:
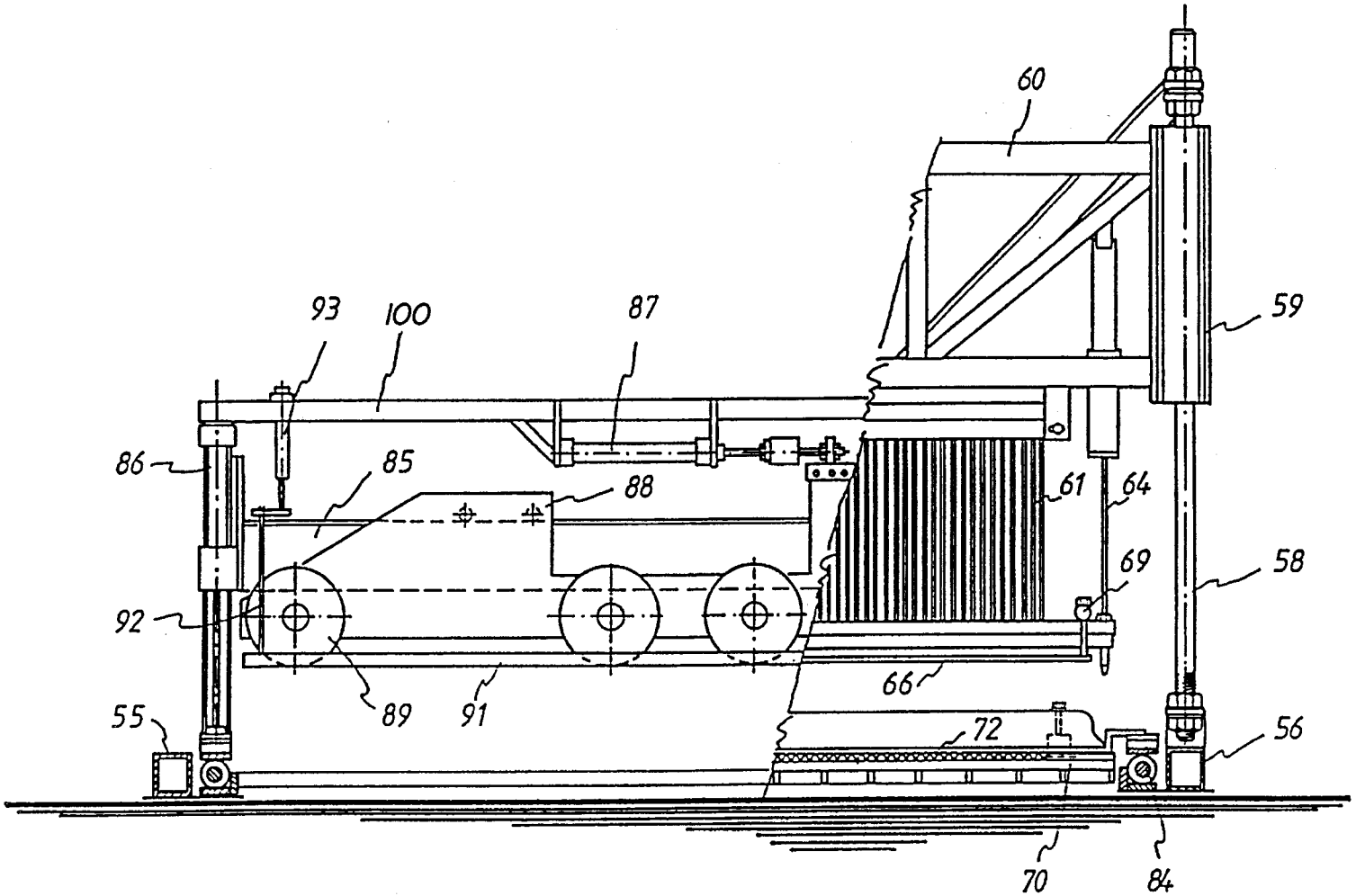
FIG. 6 is a larger-scale, cross-sectional view of the device according to FIG. 3.

As is shown in more detail in FIGS. 4–6, the frame inter alia comprises two frame beams 55 and 56 extending at least substantially parallel to the intended direction of movement of the device, said frame beams inter alia being interconnected by means of a cross beam 57.

Near the sides of the frame vertically disposed piston rods 58 are fixedly provided in the frame. Each of said piston rods 58 supports a piston, said pistion being located inside a cylinder 59, which is adjustable along the piston rod in question.

A supporting frame 60, which extends transversely to the intended direction of movement indicated by the arrow F, is secured between the two cylinders 59 (only one of which is shown in FIG. 6) disposed near the sides of the device, when seen in the intended direction of movement according to the arrow F.

The upper ends of a large number of planting pins 61 are secured to the bottom side of the supporting frame 60, said planting pins being disposed in side by side relationship in a row extending transversely to the intended direction of movement according to the arrow F.

Figure 7:
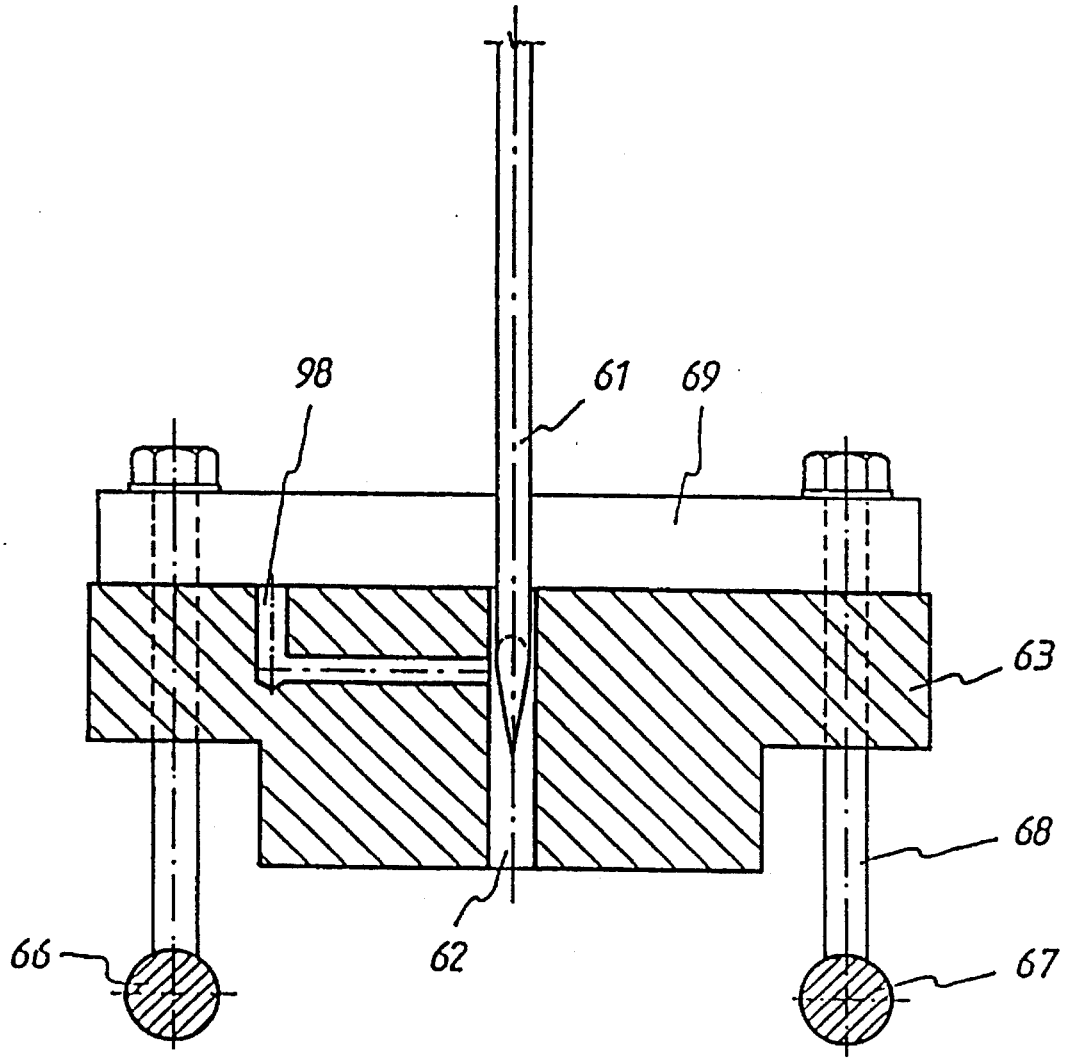
FIG. 7 is a larger-scale sectional view of a detail of the device according to FIG. 4.

As is illustrated in more detail in FIG. 7, in the position of the planting pins 61 shown in FIG. 6 the bottom ends of said planting pins are located in bores 62, which are provided in a guide plate 63.

The bottom ends of piston rods 64, which form part of air springs 65 secured to the frame 60 (FIG. 6), are secured to the guide plate 63 near the two ends of said guide plate, so that said guide plate 63 can slightly spring out in vertical direction with respect to the frame 60.

In FIG. 7 two hold-down bars 66 and 67, extending parallel to the guide plate 63, i.e. transversely to the intended direction of movement according to the arrow F, are provided near the sides of said guide plate. Vertically extending stud bolts 68 are secured to the ends of the hold-down bars, said stud bolts being passed through holes provided in the guide plate 63 and being fixed to a bar 69 extending transversely across said guide plate. It will be apparent that said hold-down bars 66 and 67 cannot move further downwards from the position illustrated in FIG. 7, but can move upwards along a certain distance with respect to the guide plate 63.

In the position according to FIG. 5 a guide plate 70 is disposed under the up-and-down movable guide plate supported by the frame 60, in which guide plate 70 passages 7I being in line with the passages 62 are provided. As will be apparent from FIG. 5, near the passages 71 the guide plate 70 is slightly thicker than at some distance from said passages 71.

As is shown in more detail in FIG. 6 V-shaped slots 72, narrowing to the bottom and extending in the longitudinal direction of the device, are provided in the upper side of said thickened part of the guide beam 70.

A first clamping strip 73, which extends parallel to the guide beam 70, is disposed to the right of the guide beam 70, when seen in FIG. 5, whilst a second clamping strip 74 is located above said clamping strip 73, which clamping strip 74 can be moved up and down by means of setting cylinders 75.

The frame 53 of the device furthermore supports a reel 76, which is freely rotatable with respect to the frame, about a horizontal axis of rotation extending perpendicularly to the intended direction of movement. A brake disc 78 cooperating with a brake band 77 is secured to one end of the reel 76. Said brake band can be brought down by means of a setting cylinder 79, if desired, so as to prevent the reel 76 from rotating undesirably fast. A large number of elongated threads 80, consisting of a plastic material, are wound on said reel in side by side relationship, said threads being cut to the desired lengths so as to form the above-described plastic fibres, as will be described in more detail hereafter.

The number of threads 80 wound on the reel 76 in side by side relationship corresponds with the number of planting pins 61 arranged in a row.

A plurality of feed-through bushes 81 (only diagrammatically shown), arranged in side by side relationship in a row, are secured to the frame, through which the threads 80 can be passed. A pneumatically or hydraulically operating clamping mechanism 82 is secured to each of said feed-through bushes 81, by means of which clamping mechanism a thread 80 extending through the respective feed-through bushes can be clamped down in the feed-through bushes 81.

The frame 53 furthermore comprises a frame-shaped slide 83 extending at least substantially across the entire width of the frame, said slide being reciprocatingly movable in the frame 53 in the direction indicated by the arrow F, between the position shown in FIG. 4 and the position shown in FIG. 5, by means of setting cylinders 84 arranged near the sides of the device. Besides the above-mentioned guide plate 70 and the clamping strips 73 and 74 said slide 83 also supports a vertically upright frame 100, in which a bearing girder 85 is vertically adjustably supported by means of two setting cylinders 86 disposed near the ends of said bearing girder 85 extending transversely to the intended direction of movement.

A trolley 88 can be moved to and fro, perpendicularly to the intended direction of movement according to the arrow F, by means of a setting cylinder 87 supported by the frame 100. Said trolley 88 supports four (only three are shown) circular knives 89, which can each be rotated, about a horizontal axis of rotation extending in the intended direction of movement, by means of a hydraulic or pneumatic motor 90 coupled to a respective circular knife.

In the position illustrated in the Figures the bottom ends of the knives are located in a slot formed in a horizontally disposed clamping strip 91 extending perpendicularly to the intended direction of movement, said clamping strip being suspended, by means of rods 92, from air springs 93 secured to the frame 100.

The frame 83 supports two further clamping strips 94 and 95 extending parallel to the clamping strip 91 , said clamping strips 94 and 95 defining a slot located directly below the slot formed in the clamping strip 91.

The operation of the above-described device is as follows.

When the device is set in action the various threads 80 are fed through the passages provided in the guide bushes 81 and, whilst the frame 83 with the parts supported thereby is in the position shown in FIG. 4, clamped down between the clamping strips 73 and 74, for which purpose the clamping strip 74 can be moved up and down by means of the setting cylinder 75 provided for that purpose.

Then the frame 83 with the parts supported thereby will be moved, by means of the setting cylinders 84, from the position shown in FIG. 4 to the position shown in FIG. 5, whereby of course the threads 80 will be drawn along through the guide bushes 81 whilst causing the reel 76 to rotate, which rotation can be braked by means of the band brake 77, if necessary. Generally this will be necessary in particular when the frame 83 reaches the position shown in FIG. 5, in order to prevent that subsequently the reel 76 will keep rotating.

Once the position shown in FIG. 5 is reached, the girder 85, which supports the trolley 88 supporting the knives, can be moved down by means of the setting cylinders 86. At a given moment the clamping strip 91 will come to lie on top of the clamping strips 94 and 95 thereby, so that the threads 80 are clamped down between said clamping strips at that location. Upon the further downward and reciprocating movement of the knives along the girder 85 the knives 89 will cut through the various threads 80, so that then a number, corresponding with the number of planting pins 61, of thread parts forming the above-mentioned artificial grass fibres extends between the clamping strips 95 and 73, whereby each thread part extends through one of the above-described V-shaped recesses 72.

It will be apparent that as a result of the spring suspension of the clamping strip 91 effected by means of the air springs 93, a suitable pressure of the clamping strip is obtained, whilst it is also effected thereby that the knives 89 can be pressed down with respect to the clamping strip 91 when the clamping strip 91 bears on the clamping strips 94 and 95.

After the artificial grass fibers to be inserted have thus been cut to the desired length of the threads 80, the frame 60 supporting the planting pins 61 will be moved down by means of the setting cylinders 59. During this downward movement the hold-down bars 66 and 67 will at a given moment come to rest on those parts of the artificial grass fibers that extend across the thinner parts of the guide plate 70 and thus clamp down said artificial grass fibers on the guide plate 71 thereby. At this point the clamping strips 74 and 91 can be moved upwards again, so that the ends of the artificial grass fibers are released. Upon the further downward movement of the planting pins 61 said pins will come into contact with the parts of the artificial grass fibers projecting beyond the passages 71 and thus press the artificial grass fibers down through the passages 71, while folding the artificial grass fibers in two and pressing them into the ground, in a similar manner as described above.

During said pressing into the ground of the artificial grass fibers said fibres are withdrawn from under the bars 66 and 67.

In order to effect that the artificial grass fibers are adequately carried along the pointed end of each planting pin is thereby preferably provided with a V-shaped recess being open at the bottom side of the planting pin and narrowing to the top.

As is furthermore illustrated in FIG. 7 a pipe system 98 may be provided in the guide plate 71, for the supply of pressurized air in the passages 62 near the location of the free ends of the planting pins in an uppermost position, so as to be able to blow away material adhering to the bottom ends of the planting pins, such as soil, by means of pressurized air, so that it can at all times be ensured that a respective part of an artificial grass fiber is correctly received in the above-mentioned V-shaped recess of a planting pin.

After the artificial grass fibers have been pressed into the ground by means of the planting pins 61 in the above-described manner, the planting pins 61 can be returned to the position illustrated in the Figures, upon which the frame 83 with the parts secured thereto can be returned from the position shown in FIG. 5 to the position shown in FIG. 4. In this position the ends of the threads 80 projecting beyond the guide bushes 81 can be clamped down again by means of the clamping strips 73 and 74, after which the the above-described cycle can be repeated again, whereby of course the tractor 50 with the devices 51 and 52 is moved along a desired distance before the next fibres are pressed into the ground.

As already mentioned before, the two devices 51 and 52 have at least substantially the same construction and operation. The arrangement of the devices with respect to each other is, however, preferably such that, when seen in the direction of movement according to the arrow F, a planting pin 61 of e.g. the device 52 is located centrally between two adjacent planting pins of the device 51, so that the artificial grass fibers planted by the device 51 are laterally staggered with respect to the artificial grass fibers planted by the device 52, when seen in the intended direction of movement according to the arrow F. Furthermore the mutual arrangement is preferably such that, when seen in a direction transversely to the intended direction of movement according to the arrow F, an artificial grass fiber planted by the device 51 is disposed centrally between two adjacent artificial grass fibers planted by the device 52.

With this fibre planting machine it is possible to provide fibres into the ground in an efficient manner.

The field according to the invention now used provides an ideal combination of the artificial grass fields known so far and a field of natural grass and it will be apparent that such a field is not limited to playing soccer thereon. Also all other sports, such as hockey, tennis, handball and golf can be successfully played on such a field of natural grass and fibres.

I claim:

1. A device for inserting elongated artificial grass fibers into the ground, said device comprising a frame which is movable across the ground and which has at least one planting pin mounted thereon so as to be movable up and down in said frame, means for placing an artificial grass fiber to be inserted into the ground under said planting pin in such a manner that the artificial grass fiber can be pressed, at least partially, into the ground by said planting pin, said device further including hold-down means for placing a holding force on the artificial grass fiber to be inserted, said hold-down means being coupled to and being movable up and down with respect to said planting pin and cooperating with a guide plate disposed under said planting pin in said frame so that the artificial grass fiber to be inserted can be clamped between said guide plate and said hold-down means.

2. A device according to claim 1, wherein said device is provided with a plurality of planting pins arranged spaced apart in a row extending transversely to an intended direction of movement of said device, said plurality of planting pins being jointly movable with respect to said frame.

3. A device according to claim 1, wherein said guide plate is provided with a plurality of recesses extending in a longitudinal direction of the artificial grass fiber for receiving the artificial grass fiber therein, said guide plate also including a plurality of through passages provided adjacent said recesses for guiding said planting pins.

4. A device according to claim 1, further including clamping means provided on said guide plate so that ends of artificial grass fibers can be clamped down, said clamping means and said guide plate being mounted on a support member which can reciprocate in an intended direction of movement in said frame.

5. A device according to claim 4, wherein said support member is provided with vertically movable cutting means which can reciprocate in a vertical direction for cutting the artificial grass fibers.

6. A device according to claim 5, wherein said cutting means is movable transversely to a longitudinal direction of said device.

7. A device according to claim 5, further including vertically movable clamping means connected to said vertically movable cutting means, said vertically movable clamping means cooperating with said clamping means to hold said artificial grass fibers.

8. A device according to claim 7, wherein said frame includes artificial grass fiber guides through which the artificial grass fibers pass, and clamping means attached to said guides for clamping the artificial grass fiber within said guide.

9. A device according to claim 1, further including a reel containing the artificial grass fibers and from which they are unwound.

10. An assembly comprised of two devices each for inserting elongated artificial grass fibers into the ground, each device including a frame which is movable across the ground and includes a plurality of planting pins mounted to said frame so as to be movable up and down in said frame, each device further including means for placing artificial grass fibers, to be inserted into the ground, under said planting pins in such a manner that the fibers can be pressed, at least partially, into the ground by the planting pins, said two devices being arranged with respect to each other, relative to a direction of movement of the assembly, such that during operation, a planting pin of one device is located at least substantially centrally between two planting pins of the other device.

11. A device for inserting elongated artificial grass fibers into the ground, said device being provided with a frame which is movable across the ground and has a plurality of planting pins mounted to the frame so as to be movable up and down in the frame, means for placing artificial grass fibers to be inserted into the ground under said planting pins in such a manner that the fibers can be pressed, at least partially, into the ground by said planting pins, a guide plate disposed under said planting pins over which the artificial grass fibers to be planted are passed, said guide plate having opposite sides, said device further including clamping means positioned on said sides for clamping the artificial grass fibers, said clamping means and said guide plate being connected to a support member which can reciprocate in said frame in an intended direction of movement.

12. The device as in claim 11, further including a reel on which artificial grass fibers are wound and from which the artificial grass fibers are unwound, said guide plate including a plurality of passages through which said planting pins reciprocate.

* * * * *